US008251395B2

(12) United States Patent
Ellison

(10) Patent No.: US 8,251,395 B2
(45) Date of Patent: Aug. 28, 2012

(54) GLIDING BOARDS AND METHODS OF MODIFYING GLIDING BOARDS

(76) Inventor: Matthew Wade Ellison, Westminster, CO (US)

( * ) Notice: Subject to any disclaimer, the term of this patent is extended or adjusted under 35 U.S.C. 154(b) by 596 days.

(21) Appl. No.: 11/483,837

(22) Filed: Jul. 10, 2006

(65) Prior Publication Data

US 2007/0164522 A1 Jul. 19, 2007

Related U.S. Application Data

(63) Continuation-in-part of application No. 10/712,115, filed on Nov. 13, 2003, now abandoned.

(51) Int. Cl.
*A63C 5/048* (2006.01)

(52) U.S. Cl. ..... 280/608; 280/602

(58) Field of Classification Search ..... 280/601, 280/607, 609, 608, 809, 14.21
See application file for complete search history.

(56) References Cited

U.S. PATENT DOCUMENTS

| | | | | | |
|---|---|---|---|---|---|
| 1,973,343 | A | * | 9/1934 | Hansen | 280/608 |
| 2,225,293 | A | * | 12/1940 | Bjork | 280/608 |
| 2,259,327 | A | * | 10/1941 | Serr | 280/608 |
| 2,295,185 | A | | 9/1942 | Serr | |
| 2,361,030 | A | * | 10/1944 | Hohmann | 280/608 |
| 3,083,977 | A | * | 4/1963 | Dunston | 280/608 |
| 3,580,596 | A | * | 5/1971 | Volkl | 280/608 |
| 3,637,226 | A | * | 1/1972 | Simon | 280/608 |
| 3,790,184 | A | * | 2/1974 | Bandrowski | 280/610 |
| 3,907,314 | A | * | 9/1975 | Tanahashi | 280/608 |
| 3,924,865 | A | * | 12/1975 | Benner | 280/608 |
| 4,083,577 | A | * | 4/1978 | Ford | 280/609 |
| 4,233,098 | A | * | 11/1980 | Urbain | 156/242 |
| 4,705,291 | A | * | 11/1987 | Gauer | 280/609 |
| 4,756,099 | A | | 7/1988 | Walkhoff | |
| 5,088,755 | A | * | 2/1992 | Jodelet | 280/609 |
| 5,141,243 | A | * | 8/1992 | Meatto | 280/602 |
| 5,462,304 | A | * | 10/1995 | Nyman | 280/609 |
| 6,015,161 | A | | 1/2000 | Carlson | |
| 6,062,585 | A | * | 5/2000 | Hess | 280/608 |
| 6,854,748 | B2 | * | 2/2005 | Wimbish et al. | 280/87.042 |
| 7,390,009 | B2 | * | 6/2008 | Trimble et al. | 280/608 |
| 2004/0080142 | A1 | | 4/2004 | Hafer | |
| 2006/0208459 | A1 | * | 9/2006 | Harris et al. | 280/608 |
| 2007/0075523 | A1 | | 4/2007 | Len | |
| 2007/0278753 | A1 | * | 12/2007 | Candler | 280/14.22 |

OTHER PUBLICATIONS

Select file history from related U.S. Appl. No. 11/679,019, dated Oct. 23, 2008 through Aug. 27, 2009, 100 pages.
International Search Report and Written Opinion issued in related PCT Patent Application Serial No. PCT/US07/62996, 9 pages, Feb. 28, 2007.
International Preliminary Examination Report issued in related PCT Patent Application Serial No. PCT/US07/62996, 9 pages, Feb. 28, 2007, 7 pages, Sep. 12, 2008.
Select File History from related U.S. Appl. No. 10/712,115, dated Apr. 7, 2005 to Oct. 10, 2006, 73 pages.
Select File History from related U.S. Appl. No. 11/679,019, dated Jul. 23, 2008, 7 pages.

* cited by examiner

*Primary Examiner* — J. Allen Shriver, II
*Assistant Examiner* — Bridget Avery
(74) *Attorney, Agent, or Firm* — Lathrop & Gage LLP

(57) ABSTRACT

Gliding boards having removable edge sections and methods of modifying gliding boards are disclosed herein. A gliding board of one embodiment includes a board body having top and bottom sides and defining a recessed area therebetween. A plurality of edge sections are removable from and replaceable to the board body, and each edge section has an engaging region complementary to the recessed area of the board body.

20 Claims, 8 Drawing Sheets

GLIDING BOARDS AND METHODS OF MODIFYING GLIDING BOARDS

RELATED APPLICATIONS

The present application is a continuation in part of U.S. patent application Ser. No. 10/712,115, filed 13 Nov. 2003 now abandoned and titled "REPLACEABLE, INTERCHANGEABLE EDGE AND GRIND PLATE SYSTEMS FOR SKIS AND SNOWBOARDS", which is incorporated herein by reference.

BACKGROUND

Ski and snowboard edges are often damaged from sliding or grinding on metal rails, trees, benches and other obstacles. This occurs on a daily basis, as grinding and sliding have become very popular tricks among younger skiers and snowboarders. Ski resorts are now regularly putting up obstacles like these for skiers and snowboarders to do tricks on. However, these types of tricks destroy the edges of the skis and snowboards, and then dull edges do not cut into hard-packed snow very well. This is potentially dangerous and reduces the amount of control and life of the skis and snowboards. Once an edge is damaged or loses its sharpness, a complete ski or snowboard can be placed on a grinder to have the edges re-sharpened. This technique can only be used a few times before the ski or snowboard is useless. If an edge is damaged due to impact with rocks or other hard surfaces, it may not only be dulled, but also bent or broken. This type of damage is costly to repair if it can be repaired at all. At the same time, sharp edges do not slide or grind well, as they tend to dig into or catch on the object being slid upon.

SUMMARY

A gliding board of one embodiment includes a board body having top and bottom sides and defining a recessed area therebetween. A plurality of edge sections are removable from and replaceable to the board body, and each edge section has an engaging region complementary to the recessed area of the board body.

A method of modifying a gliding board according to an embodiment includes: 1) selecting a first set of grind plates for installation on the board; 2) installing the first set of grind plates on the board so that outer sides of the respective first grind plates are substantially flush with outer sides of the board and so that bottom sides of the respective first grind plates are substantially flush with a bottom side of the board; 3) removing the first set of grind plates from the board; 4) selecting a second set of grind plates for installation on the board; and 5) installing the second set of grind plates on the board so that outer sides of the respective second grind plates are substantially flush with the outer sides of the board and so that bottom sides of the respective first grind plates are substantially flush with the bottom side of the board.

DETAILED DESCRIPTION OF DRAWINGS

Figure 1:
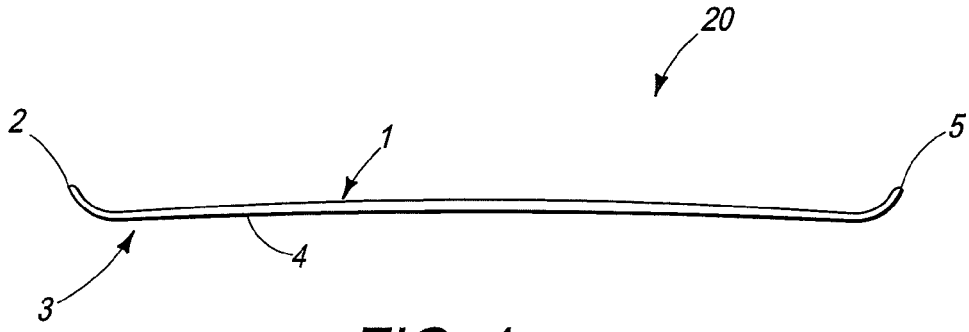
FIG. 1 is a side view of a gliding board according to an embodiment.

FIG. 1 is a side view of a gliding board 20 (e.g., a ski or snowboard) according to an embodiment. The gliding board 20 is shown in a usable configuration and includes a top 1, a tip 2, a tail 5, a bottom 3, and an edge 4.

Figure 2:
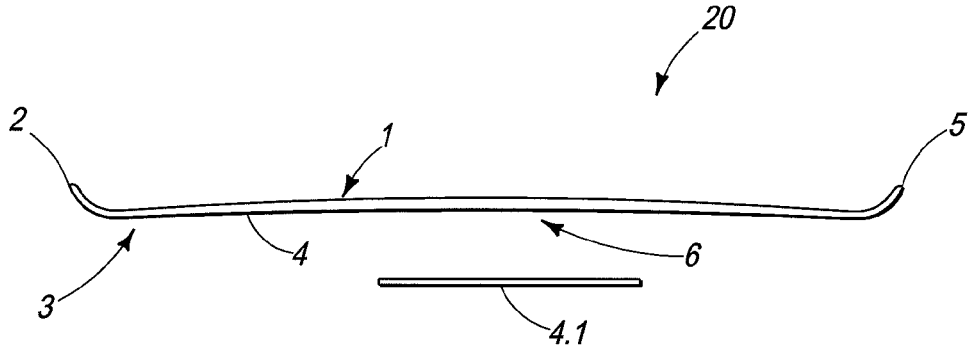
FIG. 2 is a side view of the gliding board of FIG. 1; a center edge section is shown removed.

FIG. 2 shows gliding board 20 of FIG. 1 with a center edge section 4.1 removed from its location 6 on the gliding board 20. Edge sections 4.1 (also referred to herein as "grind plates") may be made of plastic, metal, or composite materials, and various edge sections 4.1 may respectively be attached to gliding board 20 at location 6. Edge sections 4.1 are specifically designed to provide the optimal edges for conventional skiing and snowboarding, and, with a change of an edge section 4.1, the best edge for sliding (grinding). Edge sections 4.1 may be easily removed and replaced for a given activity or due to edge damage.

Edge sections 4.1 may be manufactured to correspond to a new or existing gliding board 20, and edge sections 4.1 may provide manufacturers with new design options for their products. As noted above, edge sections 4.1 may include metal, plastic, or composite materials to provide the best edge or combination of edges for a given activity (e.g., traditional skiing or sliding on rails) or for a given snow condition (i.e., ice, powder, etc.).

Figure 3:
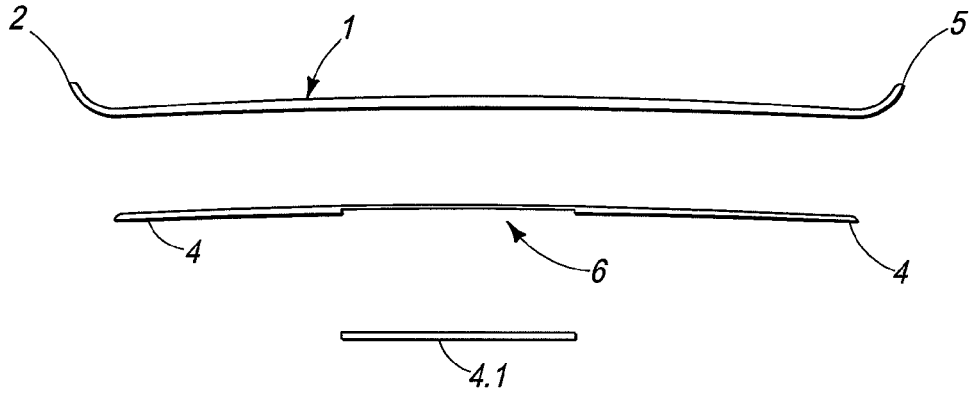
FIG. 3 is an exploded side view of the gliding board of FIG. 2.

FIG. 3 is an exploded view of the gliding board of FIG. 2, clearly showing edge section 4.1 removed from location 6. Removed edge section 4.1 can be made of plastic, metal, or composite materials and can be chosen for attachment to gliding board 20 as discussed above.

Figure 4:
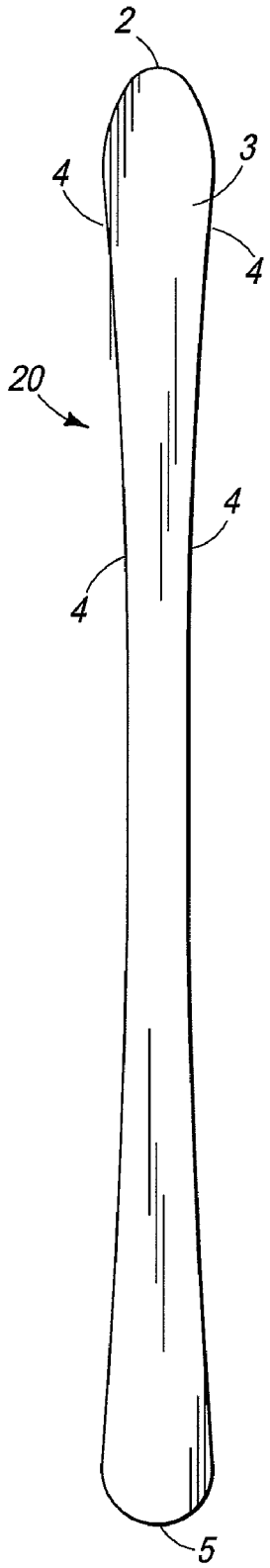
FIG. 4 is a bottom view of the gliding board of FIG. 1.

FIG. 4 is a bottom view of gliding board 20 in its usable configuration (with edge section 4.1 attached at location 6), as shown in FIG. 1.

Figure 5:
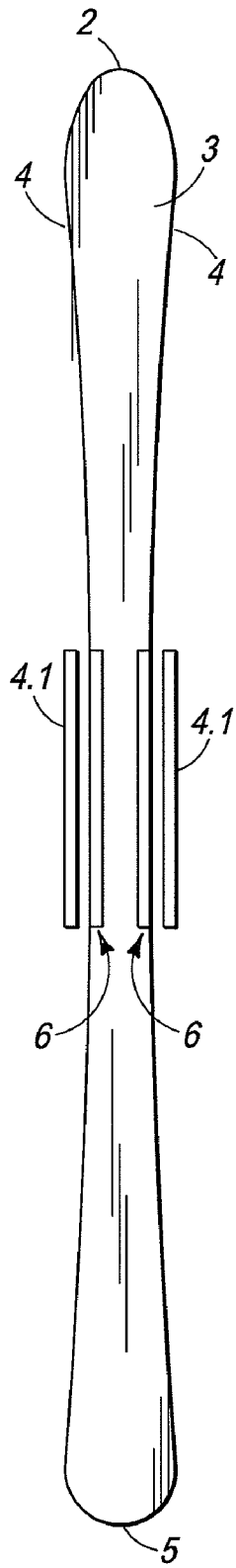
FIG. 5 is a bottom view of the gliding board (e.g., ski or snowboard) of FIG. 1; center edge sections are shown removed.

FIG. 5 is a bottom view of gliding board 20, showing edge sections 4.1 removed from locations 6. Tip 2, bottom 3 and tail 5 are labeled for clarity. Edge sections 4.1 can be made of plastic, metal, or composite materials and can be chosen for attachment to gliding board 20 as discussed above.

Figure 6:
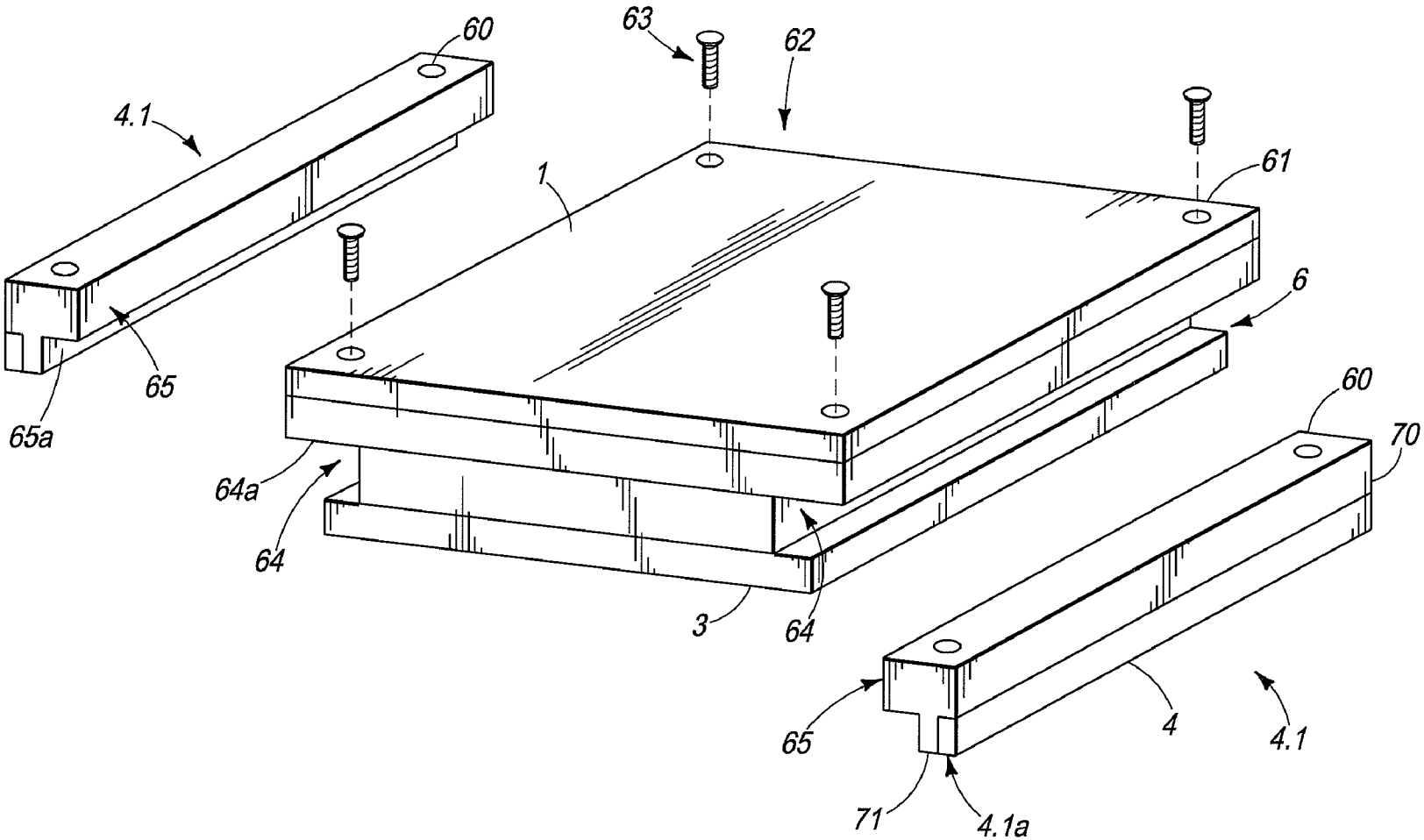
FIG. 6 is a sectional perspective view of a gliding board according to an embodiment; center edge sections are shown removed as in FIG. 5.

FIG. 6 is a sectional perspective view of a gliding board 20 showing center edge sections 4.1 removed from locations 6. Edge sections 4.1 are shown having attachment holes 60 that align with attachment holes 61 in a main body 62 of the gliding board 20, and fasteners 63 (e.g., screws, bolts, etc.) are shown for passing through attachment holes 60, 61 and attaching edge sections 4.1 to main body 62. Main body 62 is shown defining a channel or recessed region 64 between top 1 and bottom 3, and edge sections 4.1 are shown having corresponding protrusions or engaging regions 65. Complementary faces 64*a*, 65*a* of recessed region 64 and engaging region 65 are shown to be generally parallel with top 1 and bottom 3 of main body 62. An edge 4 of each edge section 4.1 may be integrally formed with the respective edge section 4.1, or the edge 4 of each edge section 4.1 may be formed as a separate portion 4.1*a* and attached to the respective edge section 4.1, such as through adhesive, a fastener, welding, etc.

Removable edge sections 4.1 are specifically designed to provide the optimal edges 4 for conventional skiing and snowboarding, and, with a change of an edge section 4.1, the best edge for sliding or grinding. Edge sections 4.1 may be easily removed and replaced for a given activity or due to edge damage, and they may be constructed of metal, plastic, composite materials, or mixtures thereof, for example. The flexibility of edge sections 4.1 may be optimized depending on whether the user is skiing/snowboarding traditionally or sliding. For example, a gliding board 20 being used primarily for skiing/snowboarding traditionally may use edge sections 4.1 having a flexibility very close to that of the main body 62, while a gliding board 20 being used primarily for sliding may use edge sections 4.1 that are more or less flexible than the main body 62. Flexible edges may be desirable when a user wants the board 20 to conform to the shape of the object being slid upon. Edges that are not flexible may be desirable when a user is sliding on rough, high friction surfaces such as concrete, because by conforming less, the edge would reduce friction and allow for a better slide.

Figure 7A:
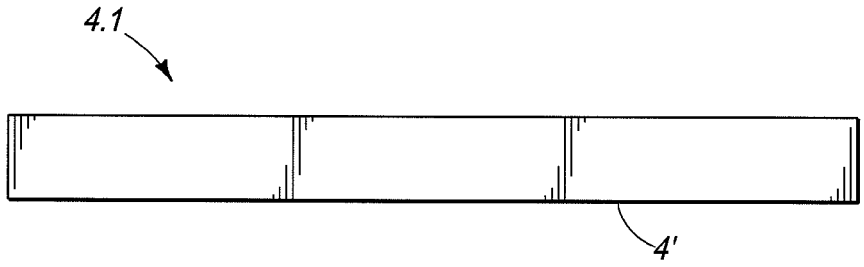
FIG. 7*a* is an exemplary center edge section having a traditional edge.
Figure 7B:
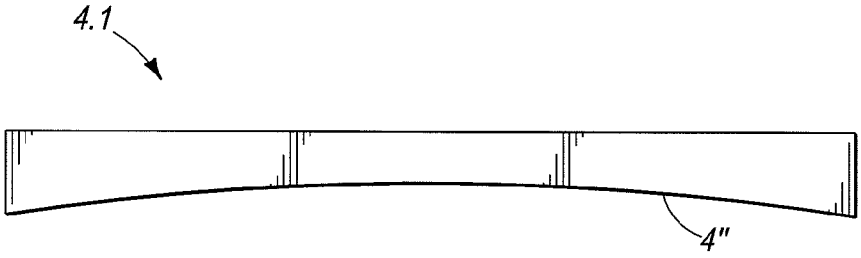
FIG. 7*b* is an exemplary center edge section having a beveled edge.
Figure 7C:
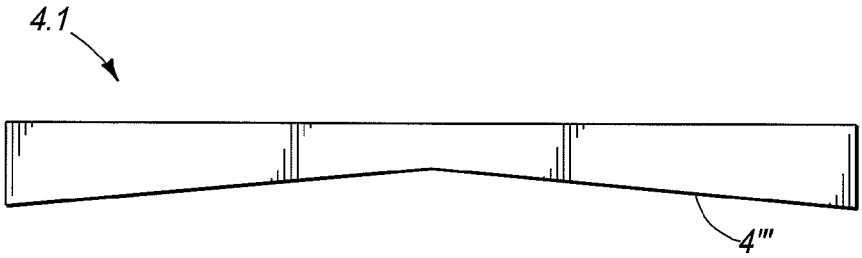
FIG. 7*c* is an exemplary center edge section having a notched edge.
Figure 7D:
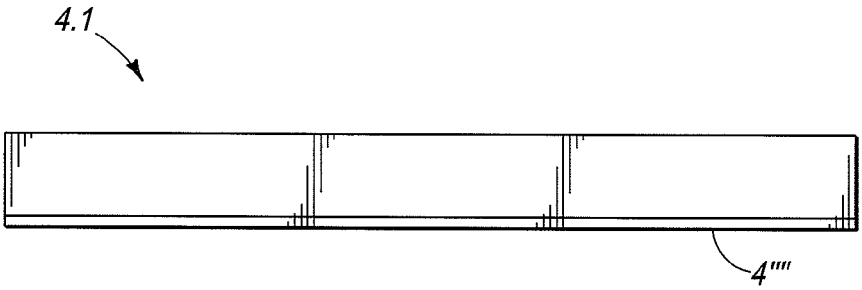
FIG. 7*d* is an exemplary center edge section having an intentionally dulled edge.

A removable edge section 4.1 having a traditional (sharp and square) edge 4' may work well for cutting into snow, but it may catch on obstacles that are being slid upon (FIG. 7*a*). A removable edge section 4.1 having a beveled edge 4" may allow the gliding board 20 to "lock" onto an object, making it easier for a user to balance or slide on obstacles (FIG. 7*b*). A removable edge section 4.1 having a notched edge 4''' may also allow the gliding board 20 to "lock" onto an object, making it easier for a user to balance or slide on obstacles (FIG. 7*c*). A notched edge 4 may not be as rounded as the beveled edge 4, and notched and beveled edges may provide different characteristics that different users prefer; they each may be advantageous depending upon the object being slid upon. A removable edge section 4.1 having an intentionally dulled edge 4'''' may provide a user with additional control, and it may slow the sliding of gliding board 20 across an object (FIG. 7*d*).

Figure 8:
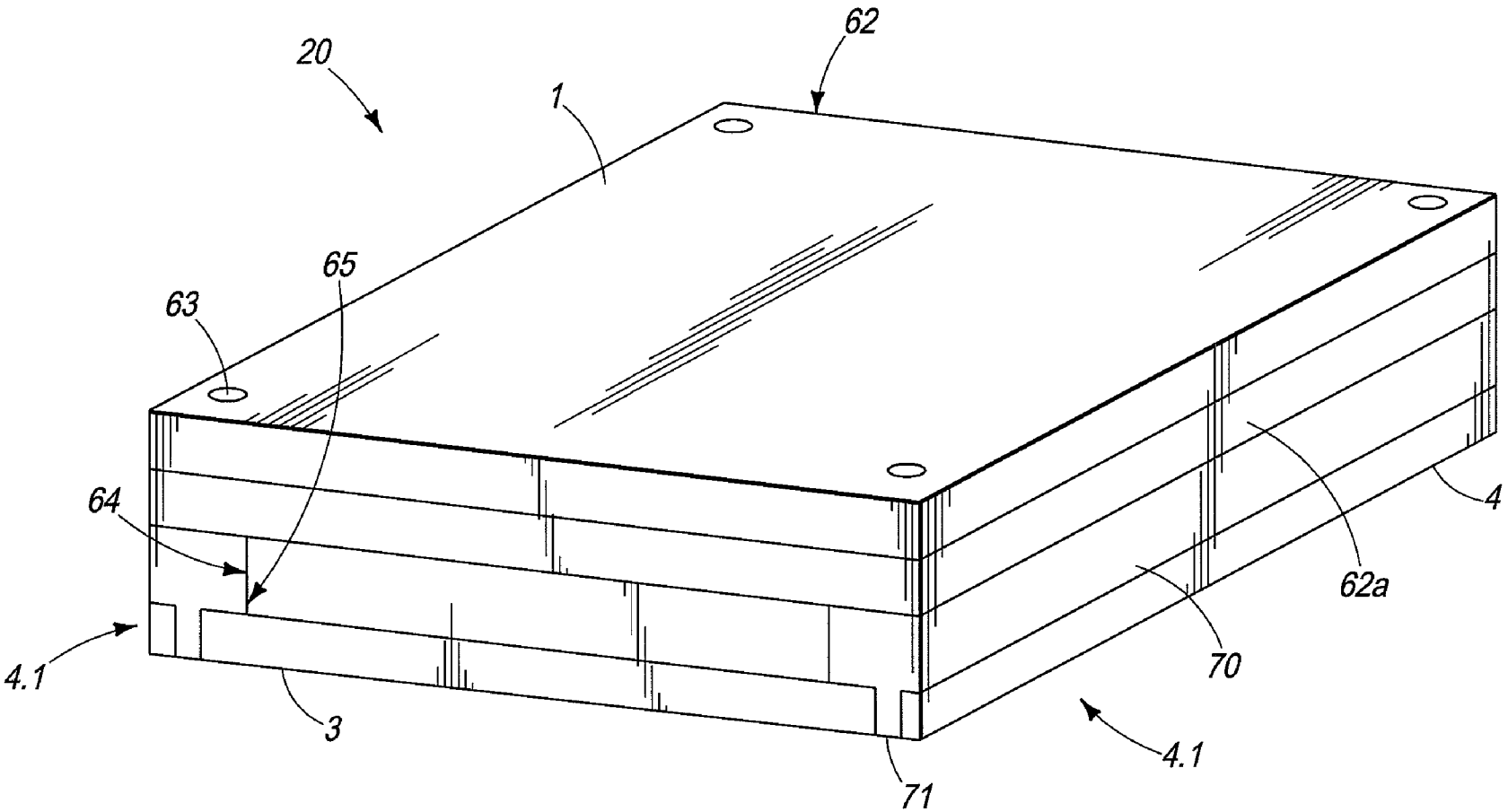
FIG. 8 is a sectional perspective view of the gliding board of FIG. 6; center edge sections are shown attached.

FIG. 8 is a sectional perspective view of the gliding board of FIG. 6 showing center edge sections 4.1 attached to main body 62. Fasteners 63 are shown to be accessible at the top 1 of the main body 62, an outer side 70 of each edge section 4.1 is shown to be generally flush with an outer side 62*a* of the main body 62, and a bottom side 71 of each edge section 4.1 is shown to be generally flush with the bottom 3 of the main body 62. Fasteners 63 may be tightened adjacent top 1 so that edge sections 4.1 may be pulled tightly to main body 62; edge sections 4.1 may alternately be attached to main body 62 through fasteners 63 that are not accessible from top 1 (i.e., bolts 63 may pass through a side of edge sections 4.1). Fasteners 63 may include tongue-and-groove fasteners, bolts, screws, clips, etc.

Recessed regions 64 and engaging regions 65 may unite to distribute forces between main body 62 and edge sections 4.1 and to secure edge sections 4.1 to main body 62. More particularly, bending forces that may be encountered due to grinding on edge sections 4.1—forces that could otherwise separate edge sections 4.1 from main body 62 or impart high forces on fasteners 63 and the top 1 of main body 62—may be distributed through main body 62 adjacent recessed regions 64 by the interaction with engaging regions 65

Figure 9A:
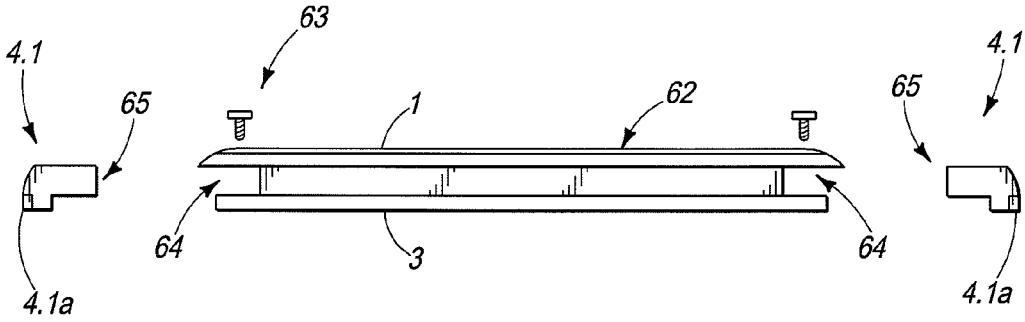
FIG. 9*a* is a front sectional view of a gliding board according to an embodiment; center edge sections are shown removed as in FIG. 5

FIG. 9*a* is a front sectional view of a gliding board 20 showing center edge sections 4.1 removed as in FIG. 5 and FIG. 6. While gliding board 20 of FIG. 9*a* is substantially similar to gliding board 20 FIG. 6, the dimensions have been altered to show that the size of edge sections 4.1 relative to main body 62 may vary and to show that the size of recessed regions 64 and engaging regions 65 may likewise vary.

Figure 9B:
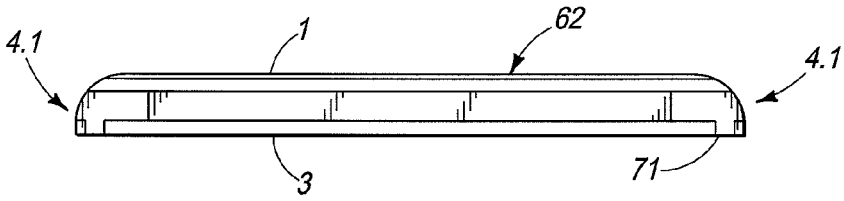
FIG. 9*b* is a front sectional view of the gliding board of FIG. 9*a*; center edge sections are shown attached as in FIG. 8.

FIG. 9*b* is a front sectional view of the gliding board 20 of FIG. 9*a* showing center edge sections 4.1 attached as in FIG. 8.

Figure 10:
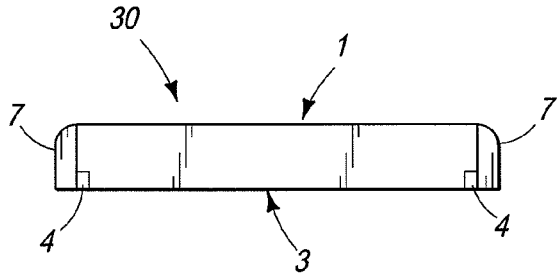
FIG. 10 is a front view of a gliding board according to an embodiment; grind plates are shown attached to sides of the board.

FIG. 10 is a front view of a gliding board 30 with grind plates 7 attached outside of its edges 4. The top 1, bottom 3 and side edges 4 are shown for clarity. Grind plates 7 can be made of plastic, metal, or composite materials, and grind plates 7 can be either permanently attached to gliding board 30 or made for easy removal and replacement. Grind plates 7 may be designed to provide protection to an edge 4 of gliding board 30 during sliding or grinding, and grind plates 7 may be designed to complement the performance of the gliding board 20.

Figure 11:
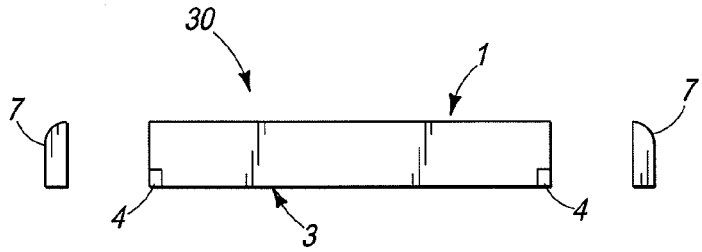
FIG. 11 is a front view of the gliding board of FIG. 10; grind plates are shown removed.

FIG. 11 is a front view of the gliding board 30 of FIG. 10, showing grind plates 7 removed from the gliding board 30. The top 1, bottom 3 and side edges 4 are shown for clarity.

Figure 12:
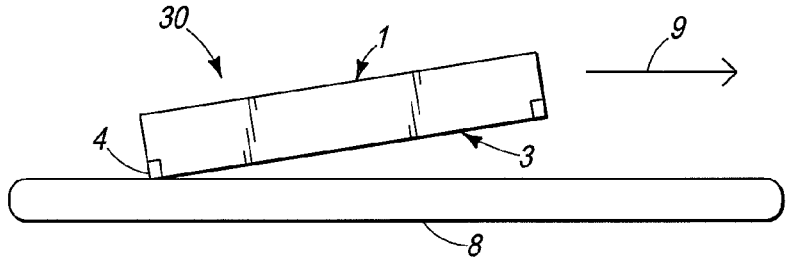
FIG. 12 is a front view of a gliding board according to an embodiment grinding (sliding) sideways on an object.

FIG. 12 is a front view of the gliding board 30 of FIG. 10 grinding from left to right 9, on an object 8 without grind plates 7. This figure shows how edges 4 come into contact with the object 8 that gliding board 30 is grinding on, which is how edges 4 may become dull and/or damaged. The top 1 and bottom 3 of the ski or snowboard are shown for clarity.

Figure 13:
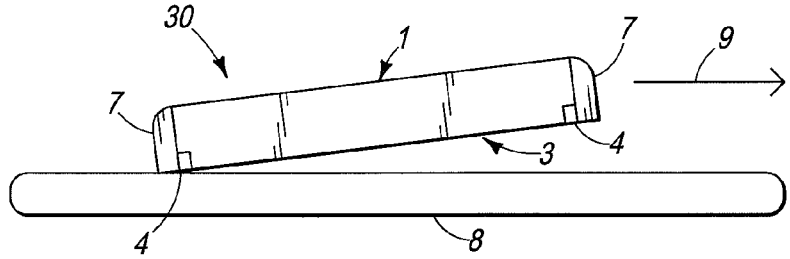
FIG. 13 is a front view of a gliding board according to an embodiment grinding (sliding) sideways on an object; grind plates are shown attached.

FIG. 13 is a front view of the gliding board 30 of FIG. 10 grinding from left to right 9 on an object 8 with grind plates 7. This figure shows how grind plates 7 protect edges 4 during grinding. The top 1 and bottom 3 are shown for clarity.

Figure 14:
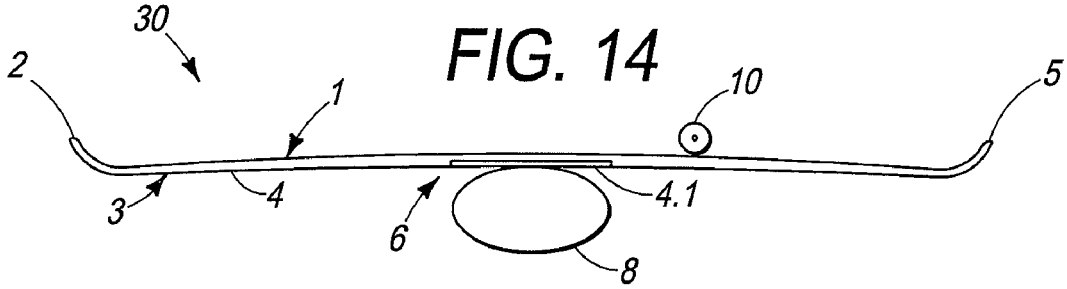
FIG. 14 is a side view of a gliding board according to an embodiment grinding (sliding) sideways on an object.

FIG. 14 is a side representation of a gliding board 20 grinding into the page (away from the viewer) 10, on an object 8. This figure shows that during grinding, edge sections 4.1 incur most of the damage. Again, edge sections 4.1 may be constructed from different materials, as soft metals, plastics and composite materials may work best for grinding while hard metals, plastics and composite materials may work best for conventional skiing or snowboarding. By having the ability to combine both into a single ski or snowboard, a user will get more usability, durability and specificity out of a single pair of skis or a snowboard.

Replaceable edge sections 4.1 and grind plates 7 may provide riders with a new level of equipment durability as well as customization, allowing for one pair of skis or a single snowboard to provide greater variety in performance and usability by being ideal for traditional skiing or snowboarding and ideal for sliding and grinding.

I claim:

1. A gliding board comprising:

a board body having top and bottom sides and defining a recessed area therebetween; and a plurality of edge sections, each edge section having an engaging region complementary to the recessed area, each edge section being removable from and replaceable to the board body, each edge section respectively being in continuous engagement with an edge of the board body section such that the edge sections are respectively selectable for use with the board body;

wherein a first set of the edge sections vary in flexibility from a second set of the edge sections, the first set of said edge sections having a flexibility that is approximate a flexibility of the board body to facilitate traditional gliding, the second set of the edge sections having a flexibility that is different from the board body flexibility to facilitate sliding; and wherein the edge sections in the second set are interchangeable with the edge sections in the first set on the board body.

2. A gliding board according to claim 1, the edge sections comprising metal, plastic or composite materials.

3. A gliding board according to claim 1, wherein at least one of the edge sections has a dull edge for sliding and grinding.

4. A gliding board according to claim 1, further comprising at least one fastener selected from the group consisting of screws, bolts, nuts, clips and tongue-and-groove for mounting the edge sections to the board body.

5. A gliding board according to claim 1, wherein at least one of the edge sections comprises a first material and at least one other of the edge sections comprises a second material.

6. A gliding board according to claim 1, the edge sections comprising composite materials.

7. A gliding board according to claim 1, the edge sections mounting along a center region of the board body.

8. A gliding board according to claim 1, wherein each respective edge section has an edge selected from the group consisting of a square edge, a beveled edge, a notched edge, and a dulled edge.

9. A gliding board according to claim 2 where the edge sections can be inter-matched with one another and the board body.

10. A gliding board according to claim 4, wherein:

the board body has an outer side; and each edge section has an outer side that is generally flush with the outer side of the board body when the respective edge section is coupled to the board body.

11. A gliding board according to claim 10, wherein each edge section has a bottom side that is generally flush with a bottom side of the board body when the respective edge section is coupled to the board body, and wherein a fastener is inserted through and accessible from a top side of the board body to secure a respective edge section to the board body.

12. A gliding board according to claim 11, wherein at least one edge section has a discrete edge portion for contact with an environmental structure such as a rail, the discrete edge portion being coupled to another portion of the edge section.

13. A method of modifying a gliding board, comprising:

selecting a first set of grind plates for installation on the board;

installing the first set of grind plates on the board so that outer sides of the respective first grind plates are substantially flush with outer sides of the board and so that bottom sides of the respective first grind plates are substantially flush with a bottom side of the board;

removing the first set of grind plates from the board;

selecting a second set of grind plates for installation on the board; and installing the second set of grind plates on the board so that outer sides of the respective second grind plates are substantially flush with the outer sides of the board and so that bottom sides of the respective first grind plates are substantially flush with the bottom side of the board;

wherein each grind plate respectively is in continuous engagement with an edge such that the grind plates are respectively interchange with the board;

wherein a first set of the grind plates vary in flexibility from a second set of the grind plates, the first set of the grind plates having a flexibility that is approximate a flexibility of the board to facilitate traditional gliding, the second set of the grind plates having a flexibility that is different from the board flexibility to facilitate sliding;

wherein a fastener is inserted through and accessible from a top side of the board to secure a respective grind plate to the board body when installing the first set of grind plates; and wherein the fastener or another fastener is inserted through and accessible from a top side of the board to secure a respective grind plate to the board body when installing the second set of grind plates.

14. The method of claim 13, the board being configured to utilize a complete set of grind plates, the first set of grind plates consisting of fewer grind plates than the complete set.

15. The method of claim 13, the first set of grind plates comprising one or more damaged grind plates.

16. The method of claim 13, the first set of grind plates having different performance characteristics than the second set.

17. The method of claim 13, wherein:

the board defines opposed recessed areas between the board top side and the board bottom side; and each grind plate has an engaging region complementary to a respective recessed area.

18. The method of claim 13, wherein the first set of grind plates has different durability characteristics than the second set of grind plates.

19. The method of claim 13, wherein installing the second set of grind plates comprises installing the second set of grind plates at locations on the board from which the first set of grind plates have been removed.

20. The method of claim 13, wherein removing the first set of grind plates and installing the second set of grind plates replaces the first set of grind plates with the second set of grind plates.

* * * * *